US005109738A

United States Patent [19]

Farian et al.

[11] Patent Number: 5,109,738

[45] Date of Patent: May 5, 1992

[54] HANDHELD SCREW DRIVING GUN

[75] Inventors: Gerhard Farian, Grossbettlingen; Guenter Haas, Wolfschlugen, both of Fed. Rep. of Germany

[73] Assignee: Karl M. Reich Maschinenfabrik GmbH, Nuertingen, Fed. Rep. of Germany

[21] Appl. No.: 728,990

[22] Filed: Jul. 12, 1991

[51] Int. Cl.[5] ..... B25B 23/04

[52] U.S. Cl. ..... 81/434; 81/432

[58] Field of Search ..... 81/434, 57.37, 432, 81/435, 433

[56] References Cited

U.S. PATENT DOCUMENTS

| | | | |
|---|---|---|---|
| 2,943,652 | 7/1960 | Chilton | 81/435 |
| 4,581,964 | 4/1986 | Takatsoru | 81/434 |
| 4,625,597 | 12/1986 | Cast . | |
| 4,807,498 | 2/1989 | Kleiser et al. | 81/434 |

FOREIGN PATENT DOCUMENTS

| | | | |
|---|---|---|---|
| 0592167 | 2/1960 | Canada | 81/432 |
| 1934559 | 1/1970 | Fed. Rep. of Germany | 81/432 |

*Primary Examiner*—Bruce M. Kisliuk
*Assistant Examiner*—Lawrence Cruz
*Attorney, Agent, or Firm*—W. G. Fasse

[57] ABSTRACT

A handheld screw driving gun (1) has a handle (17) extending essentially perpendicularly relative to the motor axis (3—3) and a screwing axis (6—6) which is off-set below the motor axis. The handle is connected approximately at the center of gravity of the screw gun (1). A screwing bit (5) is also off-set from the motor axis (3—3) and is rotatably supported in a guide head (7) between the motor axis (3—3) and the handle (17). In this arrangement, the index finger of an operator's hand on the handle approximately aligns with the axis of the screwing bit (5) so as to assure a screwing direction perpendicularly to a work surface without applying any tilting forces to a screw. The arrangement of the drive motor behind the handle and the screwing unit in front of the handle provides a balance that reduces fatigue while holding and operating the screw gun with one hand.

9 Claims, 3 Drawing Sheets

HANDHELD SCREW DRIVING GUN

FIELD OF THE INVENTION

The invention relates to a handheld screw driving gun with a drive motor and a drive train coupling the motor to a screw driving bit arranged essentially in parallel to the motor axis.

BACKGROUND INFORMATION

U.S. Pat. No. 4,625,597 (Cast), issued Dec. 2, 1986 discloses a screw driving apparatus, wherein the drive motor is connected to a screwing unit including a guide head and a feed mechanism for feeding screws which are stored in a magazine. A handle is attached to the motor housing and extends essentially perpendicularly to the motor axis. German Patent Publication DE-OS 3,333,427 corresponds to said U.S. Patent No. 4,625,597 (Cast). In the known screw gun the drive motor is arranged centrally above the handle or even inside the handle. These known devices leave room for improvement with respect to the arrangement of components to obtain an optimal balance.

In other known screw driving devices the handle is arranged all the way at the end of the drive motor opposite the end connected to the screwing unit, whereby the center of gravity or balance point of the screw driving device is located at a considerable distance in front of the operator's hand which grips the handle. It is therefore almost impossible to hold and operate such a known screw driving gun with only one hand.

A further disadvantage arises in some of the known screw driving devices because the axis of the screwing bit is arranged a considerable distance above the axis of the drive motor. This position of the axis of the screwing bit is further away from the operator's hand than necessary, thereby producing a tilting moment during the screwing operation which may lead to an undesirable tilting of the screw itself whereby the screw is driven at an undesirable slant. Besides, the tilting moment causes an excessive fatigue on the operator's hand. Thus, in order to achieve an accurate screw position and to minimize fatiguing influences, known screw driving devices normally require to be held with both hands which is frequently inconvenient and not efficient.

OBJECTS OF THE INVENTION

In view of the above it is the aim of the invention to achieve the following objects singly or in combination:

to construct a handheld screw driving gun of the type described above in such a manner that it may be securely held with one hand in any desired operating position or screwing direction while allowing an accurate, comfortable operation which causes a minimum of fatigue;

to arrange the handle of such a screw gun so that it is located essentially at the center of gravity or balance point of the screw gun and so that any tilting moment relative to the screwing bit is eliminated or at least reduced;

to offset the axis of the screwing bit below the axis of the drive motor so that the operator's index finger may be essentially in-line with the axis of the screwing bit for avoiding a slanted screw driving direction;

to provide an on-off switch bar so sized and positioned that the screw gun may be conveniently and comfortably operated with one hand on the handle;

to provide such a screw gun with at least two positions for the attachment of the screw magazine; and to provide an extension element that can be simply installed between the drive unit and the screw guide head in order to extend the length of the screw gun for convenient screwing operations on a ceiling or floor, whereby the extension element has its own handle.

SUMMARY OF THE INVENTION

The above objects have been achieved in a handheld screw driving gun according to the invention, wherein the handle is connected to the gun essentially at the center of gravity of the screw gun and wherein the drive motor extends away from the handle in one direction while the screwing unit extends away from the handle in the opposite direction. In this arrangement the handle is located with its top end essentially at the center of gravity of the screw gun to balance the drive motor and the screwing unit relative to each other. Furthermore, the screwing bit is offset from the axis of the drive motor, whereby the bit is supported in a guide head between the motor axis and the handle.

As an example, when the screw gun according to the invention is used for horizontal screwing operations, the screw gun is held by its handle below its center of gravity and with the effective line of the pressing force applied by the operator's hand essentially aligned with the axis of the screwing bit and thus with the axis of the screw to be driven, thereby avoiding canting. Through this arrangement fatiguing of the operator is minimized even if the screw gun is held with just one hand, and even in disadvantageous or difficult operating positions. Moreover, the operator's other hand is left free to be used for other purposes, for example, to hold the work piece which is to be screw-fastened.

These advantages are especially important for the screw fastening of wall panels, for example paper covered plaster wallboard panels known as "sheetrock". For screw fastening these wallboard panels it is necessary to achieve an absolutely perpendicular driving of the screw, which is possible without problems with the screw gun according to the invention. This gun construction makes sure that the screw heads do not puncture through or protrude above the paper covering layer.

In the screw gun with its gear drive train according to the invention, the drive motor is off-set above the axis of the screwing bit by the extent of the spacing required by the gear drive. The upper end of the handle of the screw gun is located essentially in the area of the gear drive and extends directly into immediate proximity with the axis of the screwing bit so that the operator's index finger of the hand holding the handle approximately aligns with the axis of the screwing bit.

In order to allow the handheld screw gun to be switched on and off in an easy and non-fatiguing manner, a switch bar forms a trigger in the handle which may be operated in any desired working position without requiring a special grip or holding position for operating the switch.

The screw gun according to the invention includes two offset attachment positions for the magazine for holding the supply of screws. Thus, it is possible to customize the screw gun for various different uses and, for example, provide the operator with a clear line of sight of the screw which is being driven. Furthermore, it is possible to provide a second handle or grip on the guide head for the operator's second hand in order to apply additional force in screwing operations requiring long duration high level axial forces, for example, for screwing in self-tapping screws.

Another feature of the invention permits rotating the screwing unit relative to the drive motor without the use of tools so that it is easy to ensure the most advantageous handle position for any of various operating conditions.

In a further embodiment of the screw gun according to the invention an extension element is provided between the drive unit and the guide head so that it is possible to use the screwing gun for screwing operations in a ceiling or on the floor while allowing the operator to stand comfortably without reaching or bending over.

With the handheld screw gun according to the invention, it is easy to attach various screwing units to the same drive motor unit or it is alternately possible to provide the screwing units with plug-in type accessory heads with which single screws can be driven.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
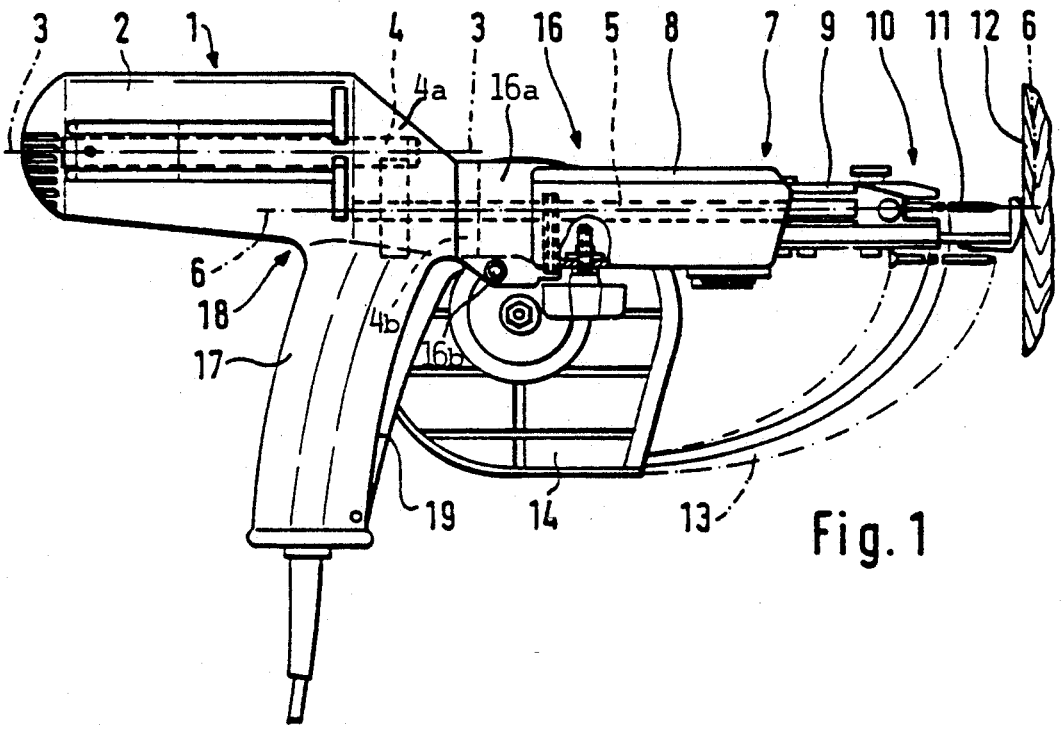
FIG. 1 is a side view of the handheld screw driving gun according to the invention.
Figure 2:
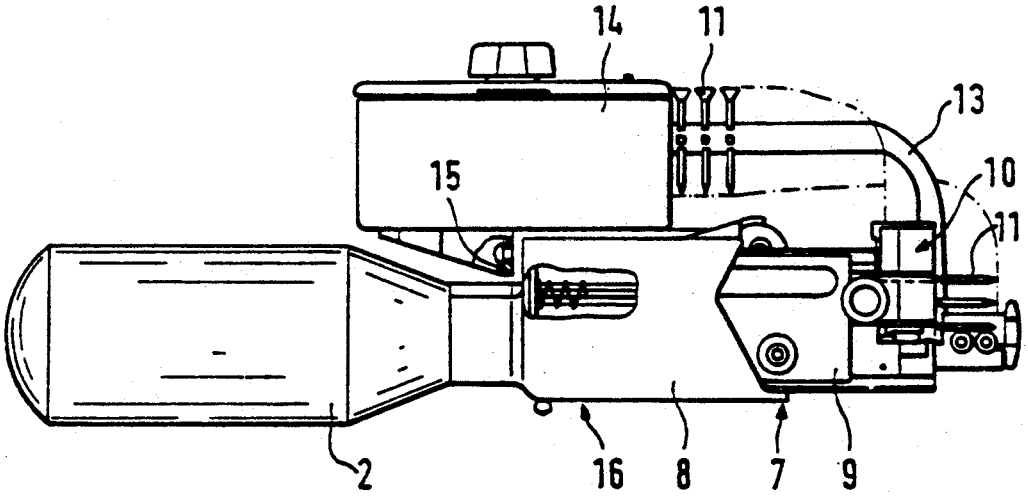
FIG. 2 is a top view of the screw gun of FIG. 1, showing the screw magazine to one side of the gun.

FIGS. 1 and 2 show a handheld screw driving gun 1 driven by an electric drive motor 2 having an axis 3—3. The drive motor 2 or rather its housing is coupled to and drives a screwing bit 5 through a gear wheel drive train 4. The screwing bit 5 has a longitudinal axis 6—6 and is rotatably supported in a guide head 7. The guide head 7 comprises a guide sleeve 8 which is rotatably connected to the drive motor 2 and comprises a bearing or support member 9 axially slideably arranged in the guide sleeve 8.

A feed arrangement 10 for the screws 11, which are to be screwed into the work piece 12, is arranged on the bearing or support member 9.

The screws 11 are, for example, connected together by means of a plastic strip 13 which may be wound up as a coil stored in a magazine 14 which is attached to an attachment surface 15 of the guide sleeve 8.

A so-called screwing unit 16 comprises the guide head 7 with its guide sleeve 8, the bearing or support member 9, and the magazine 14 which is arranged to one side of the gun, e.g., the left side as viewed in the screwing direction 6—6.

A hand grip 17 extends essentially perpendicularly relative to the motor axis 3—3 and is attached to a housing of the drive motor 2 in the area of the gear wheel drive train 4. In this arrangement the transition area 18 between the drive motor 2 and the handle 17 extends directly into the area of the extended virtual axis 6—6 of the screwing bit 5.

A trigger switch bar 19 is tiltably or movably arranged in or on the handle 17 and is operatively connected to the drive motor 2 to control the on and off switching of the motor 2.

Figure 3:
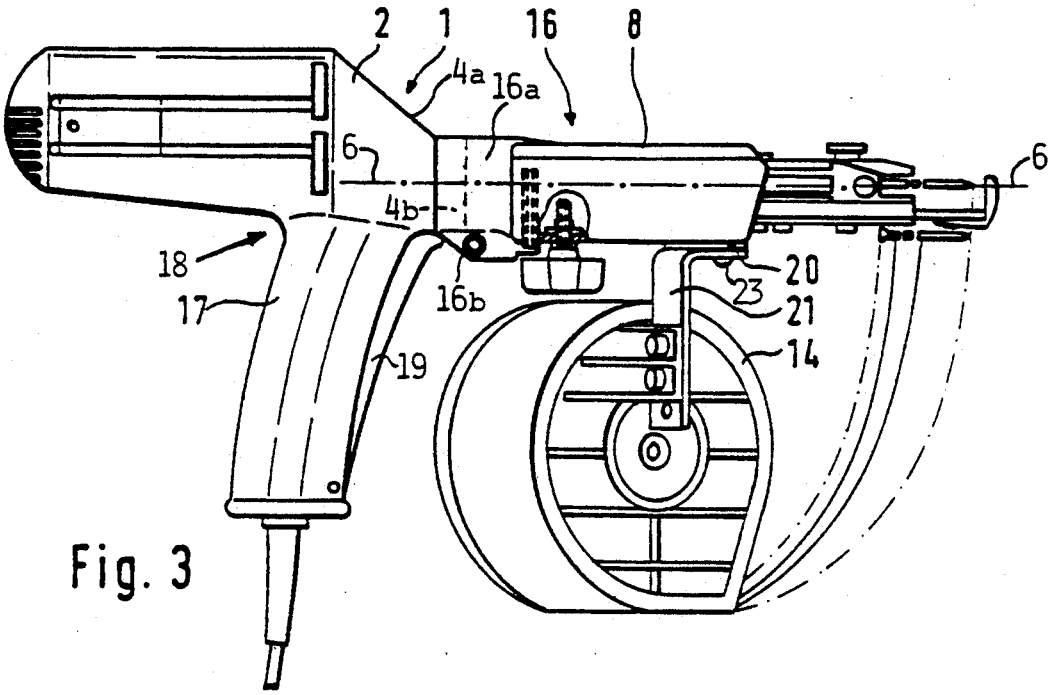
FIG. 3 is a side view of a different embodiment of a handheld screw gun.
Figure 4:
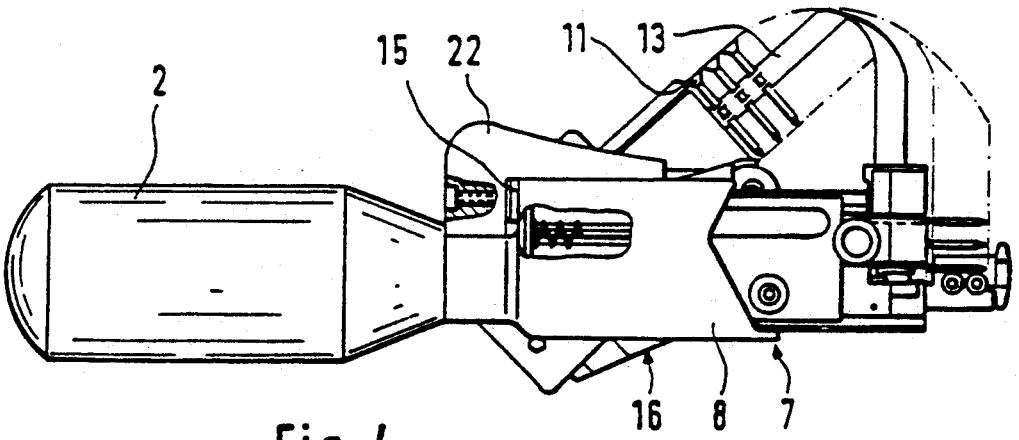
FIG. 4 is a top view of the screw gun of FIG. 3, showing the screw magazine below and at a slant to the gun.

FIGS. 3 and 4 show a second example embodiment of the handheld screw gun according to the invention, whereby the screw storage magazine 14 is attached to a second attachment surface 20 of the guide sleeve 8 by means of an angle bracket 21 to locate the magazine below the gun and preferably with a slant to the screwing direction. In this arrangement it is possible to secure a handrest 22 on the first attachment surface 15 of the guide sleeve 8 so that the screw gun may be held with both hands simultaneously if that should be more convenient for certain operating conditions, e.g. when it is desirable to apply more screwing force or pressure in the screwing direction 6—6.

The bracket 21 for mounting the screw magazine 14 to the guide sleeve 8 is secured by a screw 23, whereby the above mentioned slant of the magazine 14 relative to the screwing direction 6—6 can be adjusted by loosening the screw 23, positioning the magazine 14 as desired, and again tightening the screw 23.

Referring again to FIGS. 1 and 3, the screwing unit 16 is attached to a neck section **4*b* of a gear housing 4*a* by a split collar 16*a* that is tightened around the neck section 4*a* by a screw connection 16*b* The drive bit 5 is a plug-in type so that it can be inserted coaxially into the gear drive 4. This feature in combination with the split collar 16*a* for connecting the screwing unit 16 to the neck section 4*b* of the gear housing 4*a*, permits rotating the screwing unit 16 relative to the drive unit when the screw connection 16*b*** is loosened for adjustment.

Figure 5:
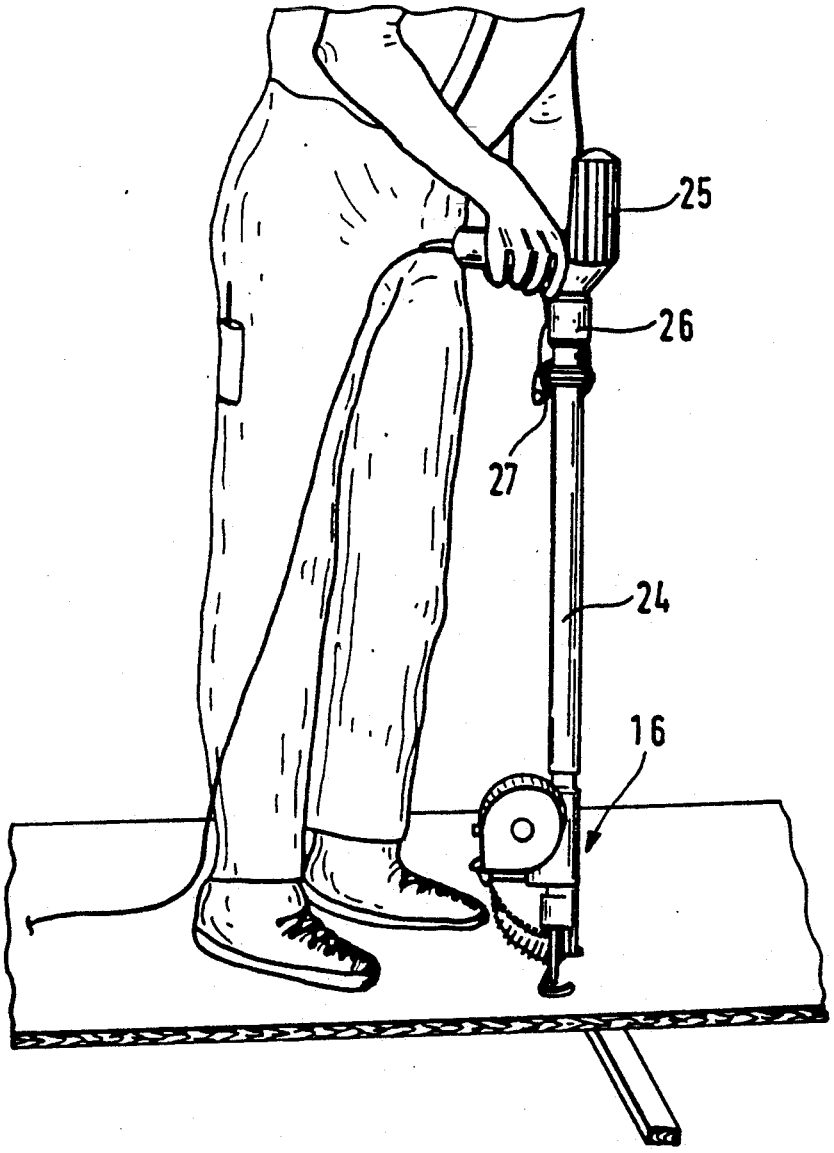
FIG. 5 shows a lengthening element between a drive unit and a driven screwing unit.

FIG. 5 shows an extension element 24 arranged between the drive unit 25 and the screwing unit 16 to make overhead ceiling and floor screwing operations easier. FIG. 5 shows that the operator does not need to kneel down. The extension element 24 is connected to the drive unit 25 by a split collar connection 26 as described above with reference to FIGS. 1 and 3. The screwing unit 16 is also connected to the extension element 24 by a split collar connection of the same type as shown in FIGS. 1 and 3, so that the screwing unit 16 may be connected directly to the drive unit as shown in FIGS. 1 to 4 or through the extension element 24 as shown in FIG. 5. In both instances the angular position of the screwing unit 16 around the screwing direction 6—6 relative to the drive unit can be selected by the operator.

Although the invention has been described with reference to specific example embodiments, it will be appreciated that it is intended to cover all modifications and equivalents within the scope of the appended claims.

What we claim is:

1. A handheld screw driving gun, comprising a drive unit having a drive axis (3—3), a screwing bit extending essentially parallel to, but off-set from said axis (3—3), a housing enclosing said drive unit, a handle attached to said housing and extending essentially perpendicularly relative to said drive axis, a screwing unit, means connecting said screwing unit to said housing, said screwing unit comprising a guide head for said screwing bit, a screw feed mechanism, and a screw storage magazine, said drive unit extending away from said handle in a direction opposite to a screwing pressure applying direction, said screwing unit extending away from said handle in said screwing pressure applying direction, whereby said handle is connected approximately at a center of gravity of said screw gun so that said drive unit and said screwing unit balance each other.

2. The screw gun of claim 1, wherein said housing comprises a transition section (18) between a motor housing section and said handle (17), said transition section extending directly close to an extension of an axis (6—6) of said screwing bit (5) which extends in said screwing pressure applying direction.

3. The screw gun of claim 1, wherein said drive unit comprises a motor and a gear drive between said motor and said screwing bit (5), and wherein said handle is attached to said housing essentially at the location of said gear drive.

4. The screw gun of claim 1, further comprising a switch trigger bar (19) for controlling the operation of said drive unit, said switch trigger bar being journalled in said handle for a tilting movement about a journal axis.

5. The screw gun of claim 1, further comprising means for adjustably securing said screwing unit to said housing, whereby the angular position of said screwing unit relative to said drive unit is adjustable around said screwing bit.

6. The screw gun of claim 1, wherein said guide head comprises a plurality of attachment surfaces off-set from one another, for attaching said screw storage magazine to said screwing unit.

7. The screw gun of claim 1, wherein said screwing unit further comprises a handrest attached to said guide head.

8. The screw gun of claim 1, further comprising an extension element (24) arranged between said drive unit and said screwing unit.

9. The screw gun of claim 1, further comprising means for easily detaching said screwing unit for exchanging various screwing units on the same drive unit.

* * * * *

UNITED STATES PATENT AND TRADEMARK OFFICE

CERTIFICATE OF CORRECTION

PATENT NO. : 5,109,738

DATED : May 5, 1992

INVENTOR(S) : Gerhard Farian, Guenter Haas

It is certified that error appears in the above-identified patent and that said Letters Patent is hereby corrected as shown below:

On the title page, insert the following:

--[30] Foreign Application Priority Data

Jul. 28, 1990 [DE] Federal Republic of Germany 4024031--

Signed and Sealed this

Twentieth Day of July, 1993

*Attest:*

Michael K. Kirk

MICHAEL K. KIRK

*Attesting Officer*

*Acting Commissioner of Patents and Trademarks*